US006032742A

United States Patent [19]

Tomlin et al.

[11] Patent Number: 6,032,742

[45] Date of Patent: Mar. 7, 2000

[54] BLOWOUT PREVENTER CONTROL SYSTEM

[75] Inventors: Jerry Tomlin, Sugar Land; Dan Pesek; Charles P. Peterman, both of Houston, all of Tex.

[73] Assignee: Hydril Company, Houston, Tex.

[21] Appl. No.: 08/987,684

[22] Filed: Dec. 9, 1997

Related U.S. Application Data

[60] Provisional application No. 60/032,947, Dec. 9, 1996.

[51] Int. Cl.[7] ..... E21B 33/064

[52] U.S. Cl. ..... 166/345; 166/387; 166/363; 166/364; 166/365; 166/366

[58] Field of Search ..... 166/342, 344, 166/345, 352, 363, 364, 365, 366, 387

[56] References Cited

U.S. PATENT DOCUMENTS

| | | | |
|---|---|---|---|
| 3,460,614 | 8/1969 | Burgess . | |
| 3,701,549 | 10/1972 | Koomey et al. | 285/24 |
| 3,817,281 | 6/1974 | Lewis et al. | 137/594 |
| 3,957,079 | 5/1976 | Whiteman | 137/596.18 |
| 4,193,455 | 3/1980 | Steddum et al. | 166/359 |
| 4,210,208 | 7/1980 | Shanks | 166/352 |
| 4,328,826 | 5/1982 | Baugh | 137/236 |
| 4,337,653 | 7/1982 | Chauffe | 73/151 |
| 4,404,989 | 9/1983 | LeMoine | 137/596.18 |
| 4,444,218 | 4/1984 | Baugh | 137/236 |
| 4,453,566 | 6/1984 | Henderson, Jr. et al. | 137/614.02 |
| 4,460,156 | 7/1984 | Hazelrigg et al. | 251/149.3 |
| 4,625,806 | 12/1986 | Silcox | 166/368 X |
| 4,636,934 | 1/1987 | Schwendemann et al. | 364/132 |
| 4,637,419 | 1/1987 | Hughes | 137/236.1 |
| 5,014,781 | 5/1991 | Smith | 166/66.5 |
| 5,070,904 | 12/1991 | McMahon, Jr. et al. | 137/560 |
| 5,074,518 | 12/1991 | Berry | 251/1.1 |

OTHER PUBLICATIONS

NL Shaffer, Product Catalog, BOP Control System, Selected pages (Date not given).

Koomey, Product Catalog, Selected pages (Date not given).

*Primary Examiner*—Roger Schoeppel

*Attorney, Agent, or Firm*—Rosenthal & Osha L.L.P.

[57] ABSTRACT

A blowout preventer control system has been developed with a pod with features which include a retractable internal stab with fixed internal hydraulic connection lines to the blowout preventer. The hydraulic connection lines are connected by pressure activated packer seals. The stab also has an electrical connector to the blowout preventer which uses a guide which proper aligns the pins of the connector without any rotation. The piping of the control system uses an adjustable length type tubing to reduce the binding on the pipe. A lost motion float is used reduce the loading on the connection bolts of the system. The entire system is enclosed with plates with keep the expended hydraulic fluid in contact with the internal mechanisms. The transducers and seal subs are located for easy accessibility with no disruption of the surrounding elements of the system.

28 Claims, 12 Drawing Sheets

BLOWOUT PREVENTER CONTROL SYSTEM

This application claims the benefit of the filing of the U.S. Provisional Patent Application Ser. No. 60/032,947, filed Dec. 9, 1996.

BACKGROUND OF INVENTION

A Blowout Preventer (BOP) is a critical feature of undersea drilling operations. The functions of a BOP, such as annular preventers and choke and kill valves, are operated by a hydraulic control system. Since the hydraulic fluid is piped from the surface, response time for deep water operations is slow due to the distances involved. As a result, an electronic or multiplex control pod is located on the BOP to effect a quicker control response. Mechanical problems or maintenance requirements occasionally require a pod to be removed and replaced. Therefore, reliability and easy maintainability are premium characteristics of a control pod.

SUMMARY OF THE INVENTION

The invention relates to a blowout preventer control system which is surrounded by a plurality of enclosure plates and comprises an electronics package which receives a control signal and relays it to a plurality of solenoids mounted within a solenoid housing. The solenoid housing also contains a non-conductive fluid, a pressure equalization bladder which is filled with sea water, and a plurality of transducers that are mounted in an accessible position within the solenoid housing wherein a transducer can be removed from the solenoid housing without disturbing the non-conductive fluid. A plurality of shear seal valves are also mounted on the solenoid housing.

The invention further comprises a plurality of seal subs which are accessible without removal of other elements of the apparatus, at least one junction plate with a lost motion float, and a plurality of adjustable length pipe spools which receives the hydraulic pressure from the seal subs. A pipe spool comprises a pipe with two threaded ends, at least one length adjustment nut which is attached to each threaded end of the pipe, a captive flange which fits over each length adjustment nut, and a plurality of bolts which fix the captive flange in place over the length adjustment nut.

The invention further comprises an internal stab which receives the hydraulic pressure from the pipe spools and transfers it through a plurality of fixed internal conduits to the blowout preventer. A plurality of pressure activated packer seals connect the fixed internal conduits of the stab to the blowout preventer. A pressure activated packer seal comprises a circular metal support with an interior ledge, an exterior slot and a bottom channel, a rubber seat attached around the interior ledge, a rubber tapered flange attached around the exterior slot, and a metal wave spring attached around the bottom channel. Also included in the stab is an electrical cable which extends through the stab, an electrical connector which connects the electrical cable to the blowout preventer, and a connector guide which correctly aligns the electrical connector without rotation. The connector is aligned by limiting the movement of the electrical connector to two perpendicular axes which are parallel to the blowout preventer. The connector guide comprises a guide frame, an upper connector member with formed flats, which is movably mounted within the guide frame, a lower connector member with formed flats, which is movably mounted within the guide frame.

DESCRIPTION OF THE PREFERRED EMBODIMENTS

The preferred embodiments of the invention are described with reference to the accompanying figures. Like references in different figures are shown with the same numeral.

The present invention relates to subsea control pods, such as shown in U.S. Pat. Nos. 3,460,614, 3,701,549, and 3,817,281 for controlling various subsea wellhead drilling functions, such as the operation of blowout preventers. Thus, the present invention is particularly used in pressure control and is suitable for deep water drilling.

Figure 1:
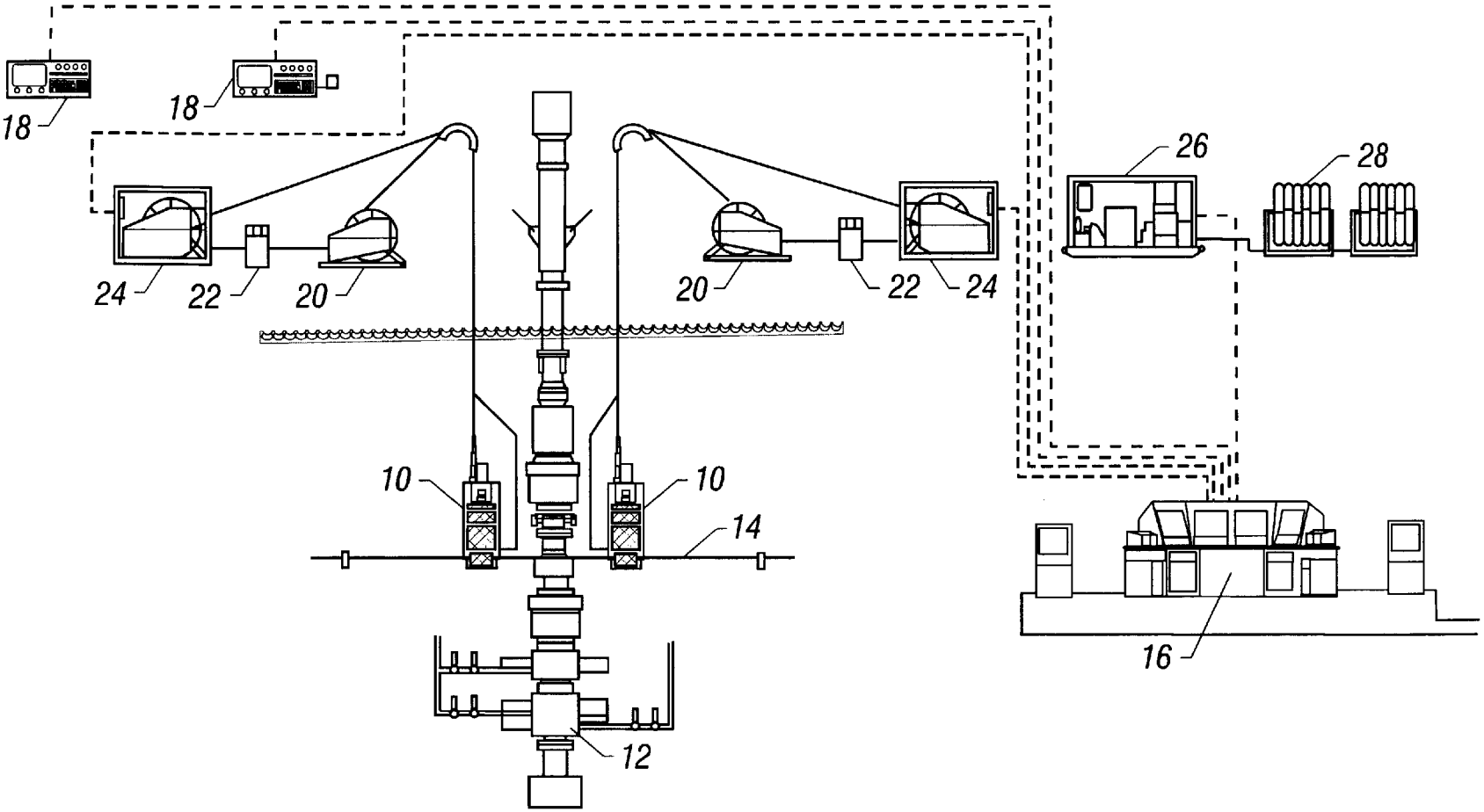
FIG. 1 shows a typical deep sea drilling operation.

FIG. 1 illustrates a typical under sea drilling operation. The BOP 12 extends through the lower marine riser package 14 (LMRP). The LMRP is separable into an upper stack 15 (shown in FIG. 4) and a lower stack 17 (shown in FIG. 4). There are times when the upper stack of the LMRP 14 must be disconnected from the lower stack which remains attached to the wellhead. The lower stack bore is then closed with shear rams and the choke and kill valves are closed. The connections for a control pod 10, located on the side of the LMRP 14, are retracted in order to prevent damage to the control pod 10.

The operation is arranged with dual identical control systems for redundancy purposes. A system may be controlled through a central control unit 16 (CCU) or a control panel 18. The control signals are sent to the pod 10 through a cable which is spooled on a mux reel 24 and extends to the pod. The hydraulic fluid for the system is supplied by a hydraulic pump unit 26 with its surface accumulators 28. The fluid is transferred to the control pod 10 through a "hot line" which is spooled on a hot line reel 20 during the movement and return of the LMRP. The main hydraulic fluid supply line is a rigid supply conduit which is incorporated into the riser once the BOP is placed.

Figure 2:
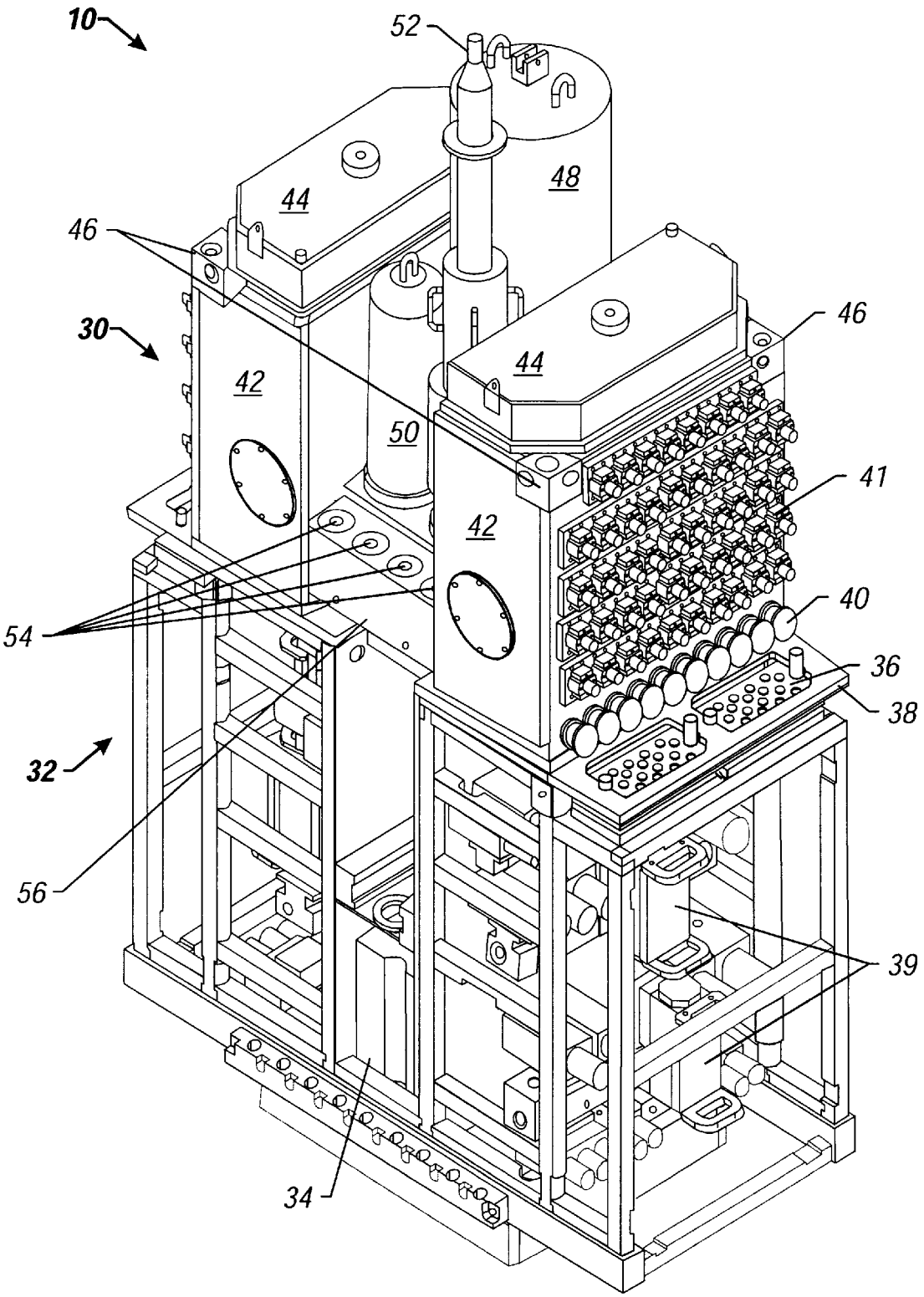
FIG. 2 shows a perspective view of a BOP control pod.
Figure 4:
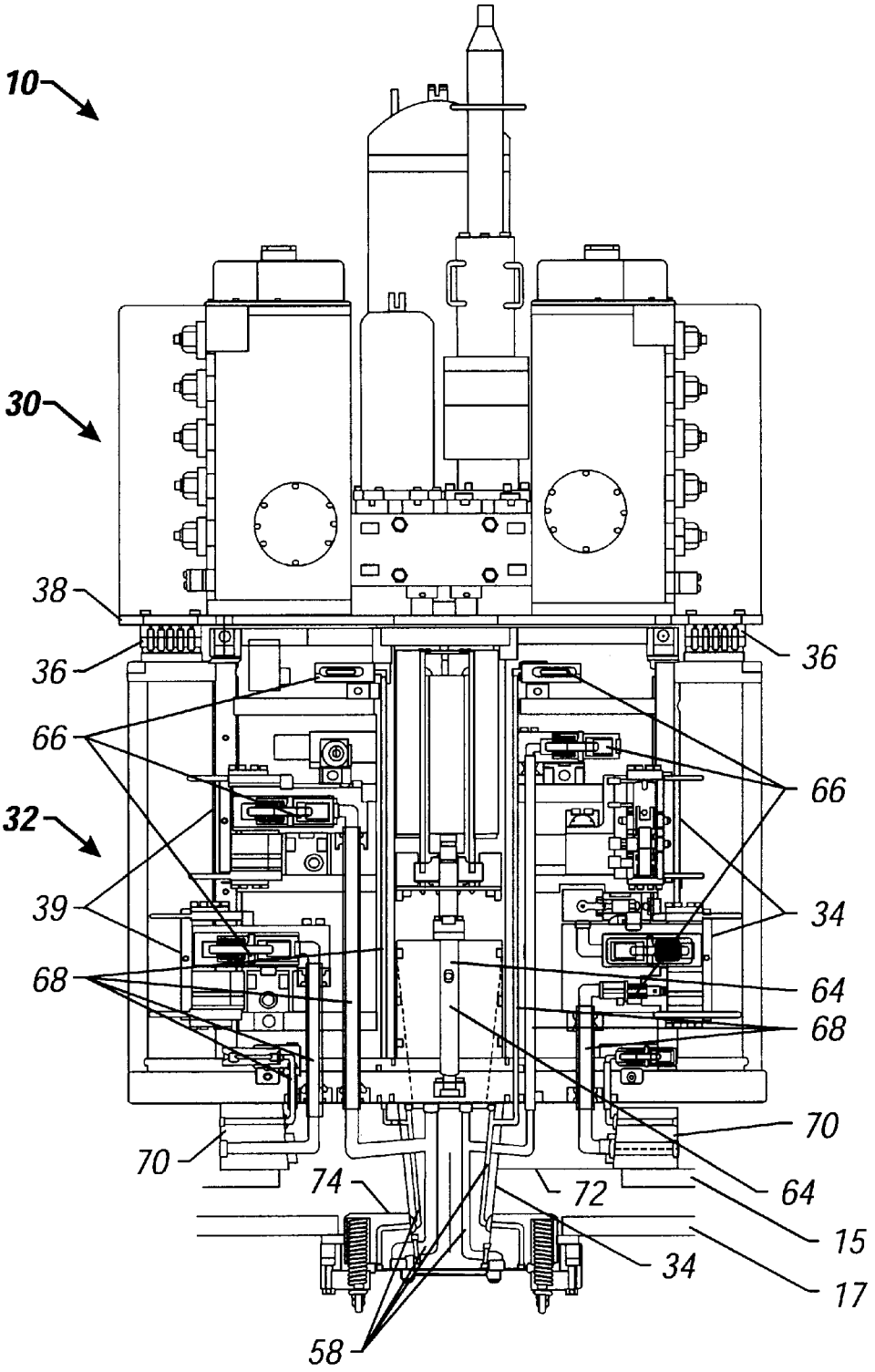
FIG. 4 shows a frontal view of a BOP control pod connected to the BOP receiver block.

FIG. 2 illustrates a perspective view of a subsea control pod 10 in accordance with the present invention. In a preferred embodiment, the pod 10 includes an upper electronics module 30 mounted atop a lower hydraulic module 32. A hydraulic cylinder 64 (not shown in FIG. 2) is mounted at the center of the lower module 32 for lowering a male member, or stab 34 into engagement with the BOP receiver block 74 (not shown in FIG. 2) which is mounted on the lower stack of the BOP 12. In FIG. 2, the stab 34 is shown in the disengaged, retracted position. In FIG. 4, the invention is displayed with the stab 34 in the engaged, lowered position.

Figure 5:
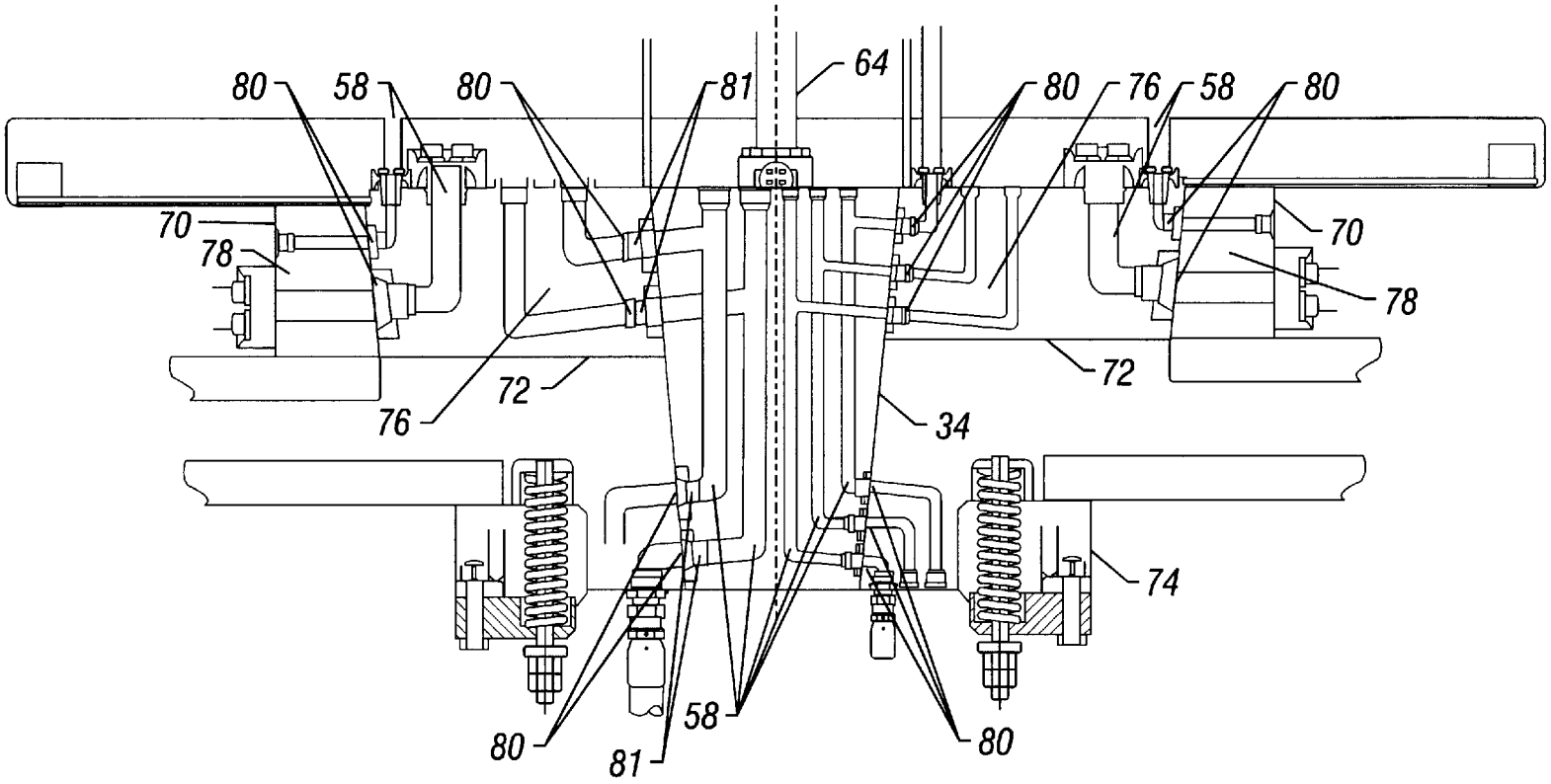
FIG. 5 shows a frontal view of the pod base block and the stab connected to the riser receiver block and the BOP receiver block.

One significant advance provided by the present invention is the provision of an integrated stab 34 and pod base block 72 design, which are shown more particularly in FIG. 5. Currently, the art utilizes separate stab members, apart from the main pod, that are each lowered and retracted. Subsea pods utilizing such systems require that bundles of hoses be connected between the main pod and these separate stabs for hydraulic communication.

With the present invention, a single stab 34 is built into the pod 10. Thus, it eliminates the hoses, simplifies the overall system, and improves reliability. Even though the pod 10 has a large footprint from the integration of functions, the invention eliminates other devices that are outside of the pod 10 and is therefore a very efficient way of communicating from the pod 10 on the LMRP 14 to the BOP receiver block 74 mounted on BOP receiver stack with a single retractable stab 34. In effect, the single stab 34 functions with the pod base block 72 like a big, quick disconnect.

The retractable stab 34 does away with the need for hoses to provide inter-connections between the pod components through the use of a plurality of bores, or conduits 58 that are machined into it, as shown particularly in FIG. 5. The stab 34 is designed to work with the specially designed pod base block 72 which also has internal conduits 58 that terminate in upper sealed points for engagement with the stab conduits. Thus, the pod base block 72 includes inboard conduits for operation of the BOP stack functions, and outboard conduits for operation of the riser functions. The outboard side 78 sealingly engages the riser receiver block 70, and the inboard side 76 sealingly engages the upper stab when the stab 34 is lowered. The stab 34, in turn, sealingly engages the BOP receiver block 74 at the bottom.

Figure 3:
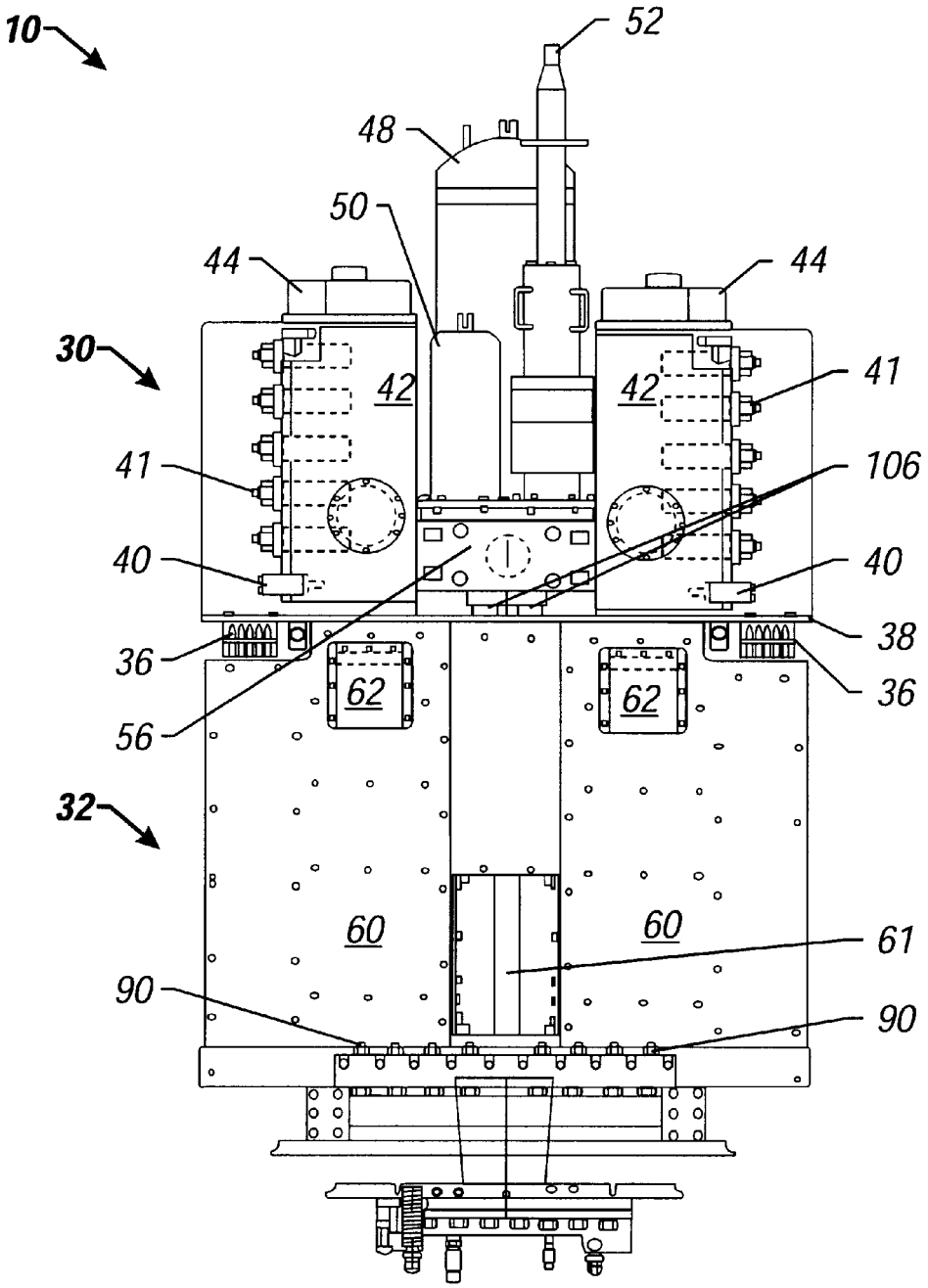
FIG. 3 shows a frontal view of a BOP control pod with enclosure plates.

FIG. 3 shows the control pod with enclosure plates 60 attached to the lower module 32. The plates serve to enclose the hydraulic module 32 so that the expended hydraulic fluid is contained and expelled only through the module vents 62. This keeps the expended fluid on the exhaust side of the hydraulic control valves and in turn keeps control fluid in contact with the vented side of the BOP and stack valves. Contact with the expended fluid is much preferred over contact with sea water. These features also give the pod the flexibility to be arranged as a "closed system" where the expended hydraulic fluid is recovered by the system. Also shown is a protective screen 61 which protects the module from collecting trash when the stab 34 is extended.

As shown in FIGS. 4 and 5, all the fluid piping comes into an intermediate, pod base block 72 so there are no moving pipes or hoses on the pod 10. The pipes, or pipe spools 68, are fixed and feed upper seal points on the pod stab 34 when the stab is in the extended position, as shown in FIG. 4. The hydraulic fluid communicated through the upper seal points flows through the conduit 58 in the stab 34, and out the lower seal points to enter the BOP receiver block 74 for activating various stack functions. The hydraulic cylinder 64 jacks the pod stab up and down. The fixed pipe spools 68 connected to the pod base block 72 are fed from above by valves in the pod 10 itself, as discussed further below.

Figure 9A:
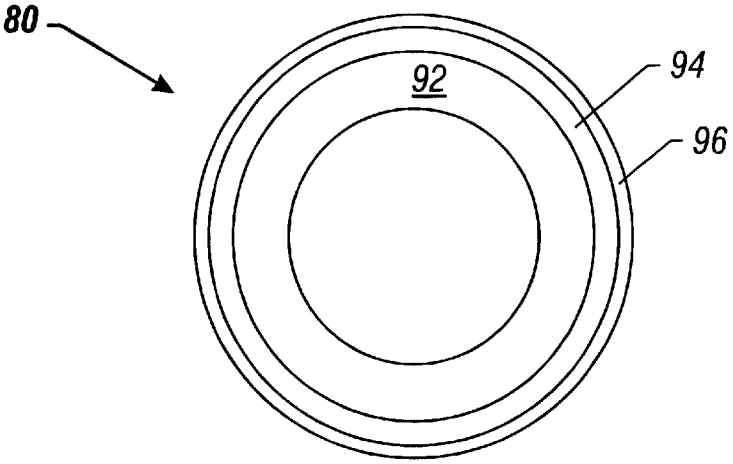
FIG. 9*a* shows an overhead view of a pressure energized packer seal
Figure 9B:
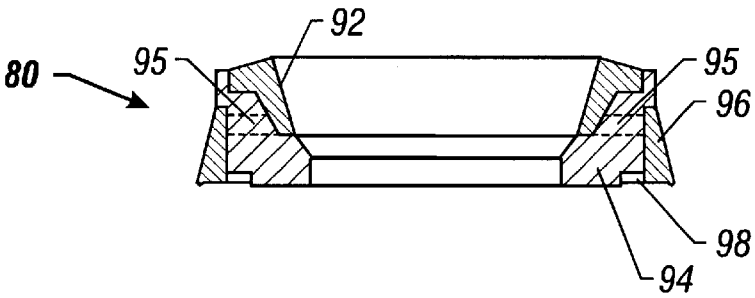
FIG. 9*b* shows a cross-sectional view of a pressure energized packer seal.

As shown in FIG. 5, the junctions between the conduits 58 from the stab 34 and both block are sealed with pressure energized packer seals 80. FIGS. 9*a* and 9*b* show a pressure energized packer seal 80 which comprises a circular rigid support 94 with a flexible seat 92 attached around its interior. The outer edge of the rigid support contacts the seal pocket 81. This provides support to keep an extruding gap from forming between the packer seal and the pocket. The flexible seat 92 extends above the rigid support 94 which allows a compression seal to be formed when pressure is applied. An outwardly tapered flange 96 is attached around the exterior of the rigid support 94. Holes 95 are present are various intervals within the rigid support 94. This allows the flexible seat 92 and tapered flange 96 to make contact when the packer seal is being molded. Also, a wave spring 98 is fitted around the base of the rigid support 94. A wave spring 98 is a circular strip with periodic undulations which allow some elastic compression. The rigid support 94 and the wave spring 98 are usually metal, but any other suitable materials could be used. The preferred material is a nickel, aluminum and bronze alloy which prevents galling. The flexible seat 92 and the tapered flange 96 are usually rubber, but any other suitable material could be used.

The key to the pressure energized packer seal 80 is the tapered flange 96. A dynamic seal forms when pressure is exerted on the tapered flange 96. The flared surface is forced out against the interior diameter of the seal pocket 81 in the end of the conduit 58. This device will maintain a tight seal should any movement of the structure take place which could cause the seals to leak.

Figure 6:
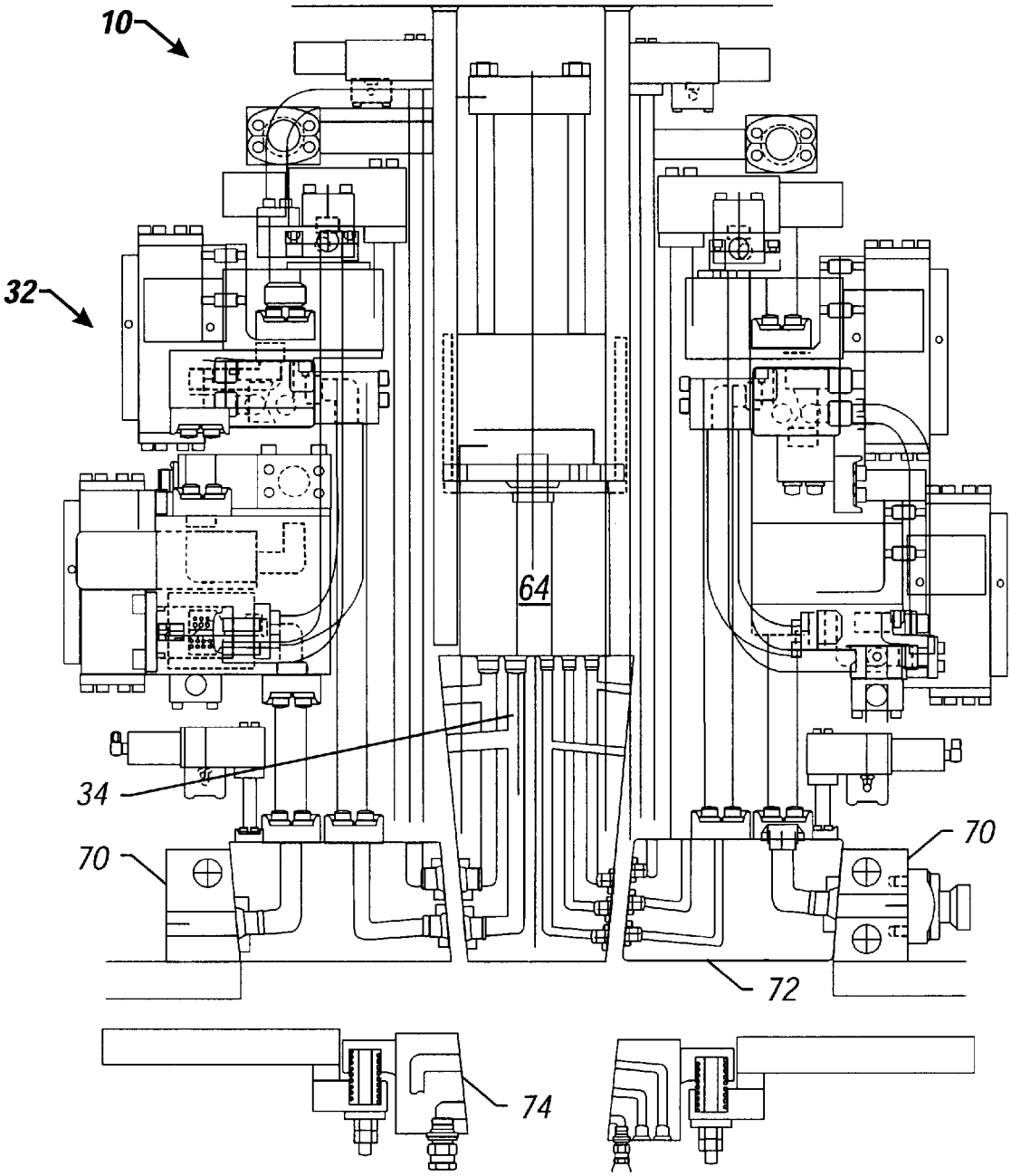
FIG. 6 shows a frontal view of a BOP control pod with the stab disengaged from the BOP receiver block.
Figure 7:
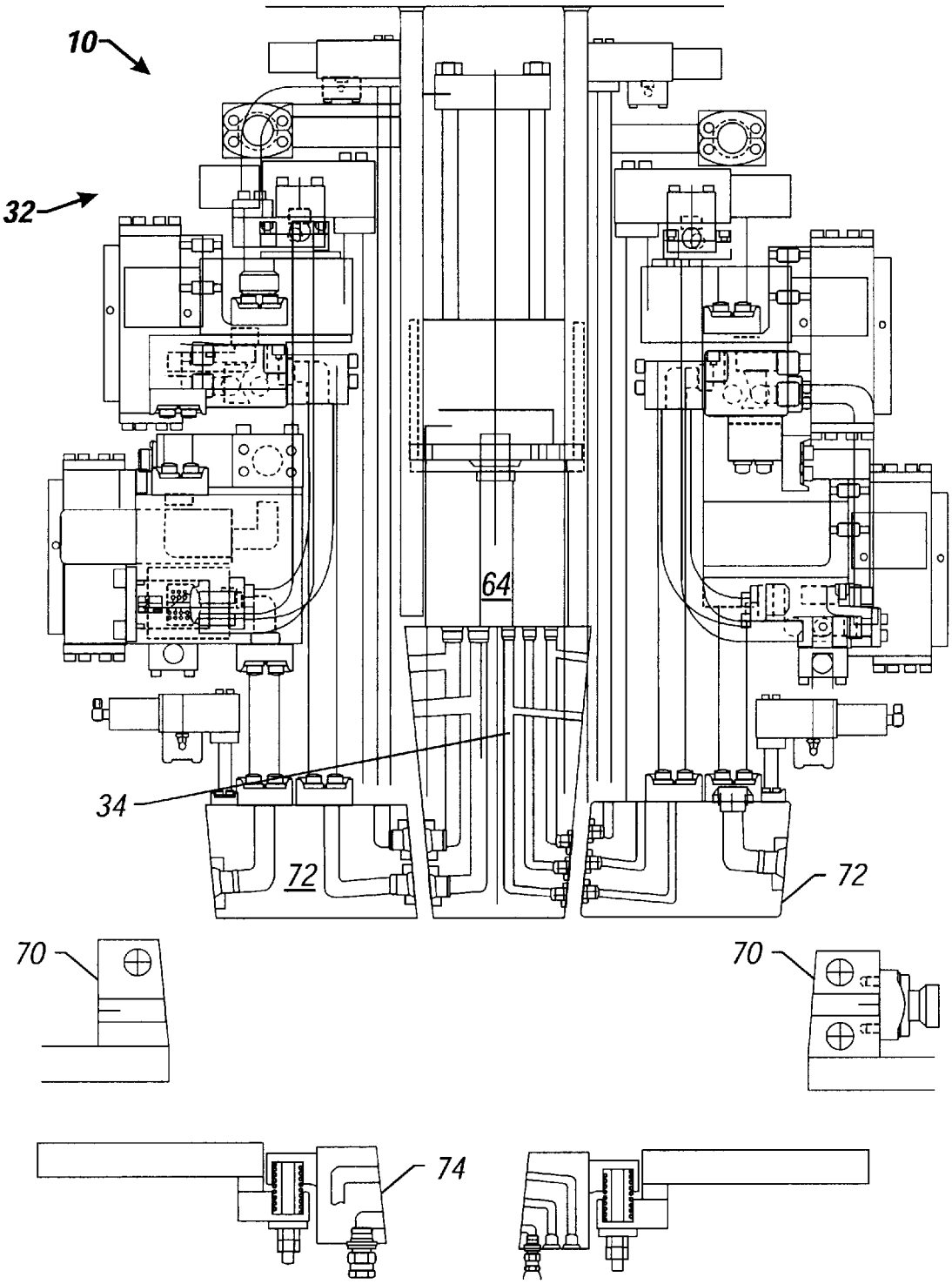
FIG. 7 shows a frontal view of a BOP control pad with the stab disengaged from the BOP receiver block and the pod base block disengaged from the riser receiver block.

FIGS. 4 and 5 show the pod 10 being engaged to the riser receiver block 70 through the pod base block 72 and the BOP receiver block 74 through the pod stab 34. Any time the rig operators are going to disconnect the riser package and leave the lower BOP stack on the wellhead, they retract all stabs 34 before they disconnect the riser. The tapered stab 34 must be retracted by its hydraulic cylinder 64 before disconnecting the riser package from the lower BOP stack. Fully retracting the stab disengages it from the BOP receiver block as shown in FIG. 6. The stab 34 is designed to be fully retracted into the body of the lower pod module so as to provide ready access to the pod base block's pressure energized packer seals 80 for servicing. Once the stab 34 is fully retracted, the pod base block 72 is hydraulically disconnected from the BOP receiver block 74 which remains attached to the riser package. When the pod base block 72 is disconnected, the entire pod 10 is disengaged from the riser package as seen in FIG. 7. At this point, there are no stabs extending downward into the riser package.

The pod 10 per se is not intended to be retrievable subsea, but it's designed to be a quick change unit so that when installed, it is bolted in place as shown in FIG. 3. The pod 10 is mounted by eight bolts 90 on each side which fix the whole pod structure to the riser receptacle assembly. While bolts are shown for an attachment mechanism, any other suitable means could be used including clamps for use in a recoverable control pod. Thus, by removing the bolts 90, one pod can be taken off the riser package and another one can be bolted in its place if necessary. For example, if a particular user had three pods, there would only be two active pods on the BOP stack. In the event that a malfunction was identified in one of the active pods, that pod could be removed and replaced with the spare on deck. Thus, drilling operations can be resumed fairly quickly, while the malfunctioning pod was being serviced.

Aside from the mounting bolts 90, there are five electrical cables that must be disconnected to isolate the pod from the LMRP. First, there is the main electrical cable, or main umbilical, which is carried on a reel on the surface deck, and which basically operates the pod by enabling communication with the panels and electronics on the surface. Thus, the main umbilical cable provides all essential electrical power and signal communications. The main umbilical connector 52 must be disconnected when recovering the pod from the LMRP riser package. When the cable is retrieved back to the surface, it is spooled up on the reel so the main umbilical connector 52 can be disconnected from the upper module 30. At this point, the pod 20 is effectively isolated from the surface and must be retrieved. The main umbilical connector may be a "make and break" connector for a recoverable pod configuration.

Also, there is space for four external cable connections 54 that are mounted to the upper pod module 30, as shown in the plan view of FIG. 2. These cables enable the recording of certain data, such as pressure and temperature on the riser package. In other words, they are data acquisition and possible operation cables for temperature, pressure, and other variables, and also communicate with the electronics on the surface deck.

Once the cables are disconnected, and the pod 10 is fully disengaged, it can be lifted off the riser receiver block 70 so that the replacement pod can be bolted in its place. Virtually all subsea systems have at least two pods for redundancy.

As implied above, the pod 10 itself is a modular unit including an upper electronics module 30 that can be separated from a lower hydraulic module 32. Thus, a rig operator could replace the hydraulic module 32 by disconnecting the electronics module 30 at the junction plate 38, and moving the electronics module 30 so that the replacement could occur. None of the electrical components would have to be disturbed. The modules are designed for optimum adaptability, so that virtually any electronic module will mount to any hydraulic module, regardless of specific configurations.

With reference now to FIG. 4, the hydraulic regulators 39 and sub-plate mounted (SPM) 66 valves that feed the pipe spools 68 connected to the pod base block 72 are shown with the lower module 32. The pipe spools 68 are basically sub seals 36, in the form of tubing with O-rings 82 on each end. The spools are threaded for connection at both ends, which provides an adjustable-length inter-connection between the SPM valves and the pod base block for either outboard riser functions or inboard BOP functions.

Figure 8:
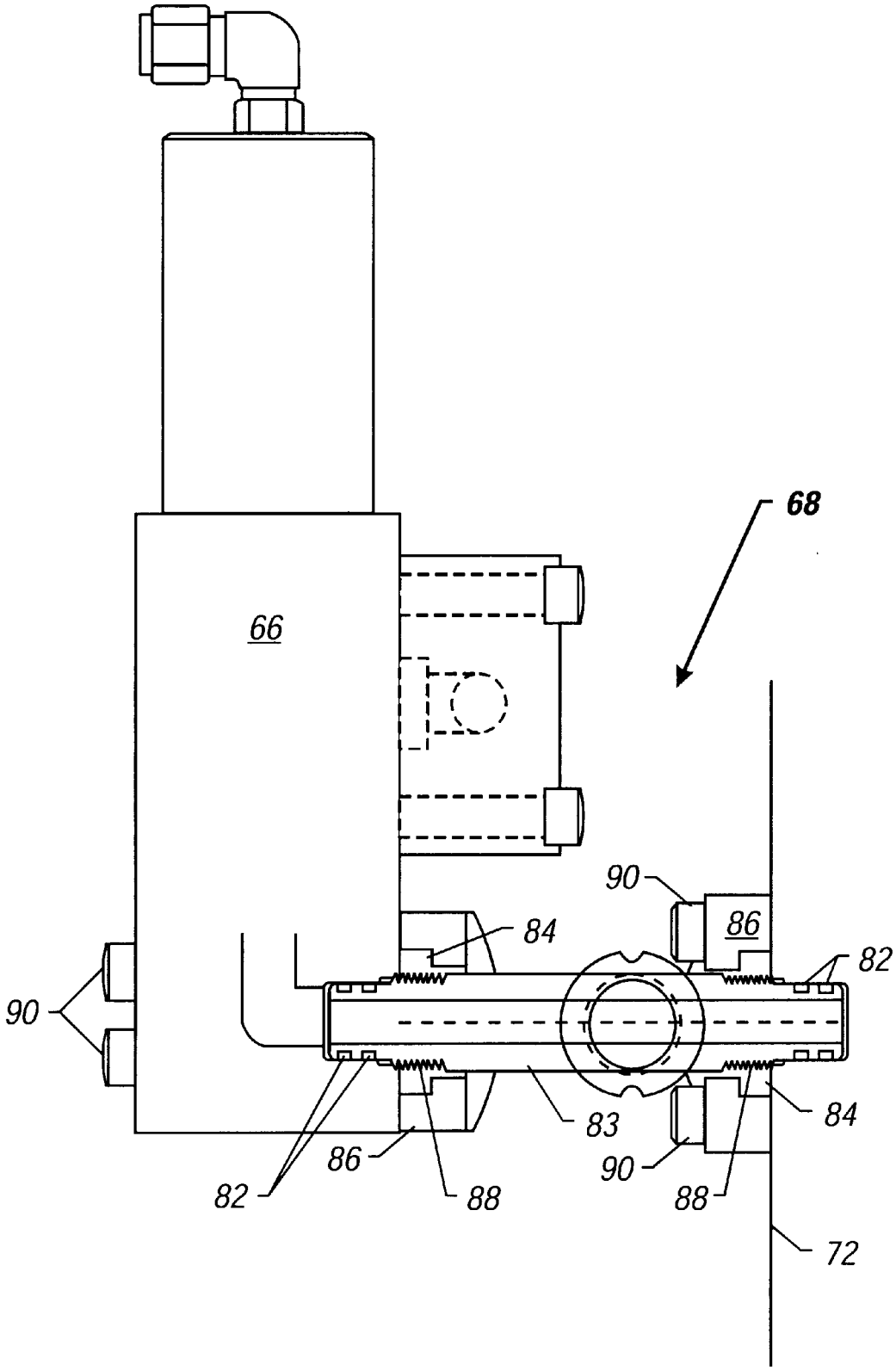
FIG. 8 shows a frontal view of a pipe spool connected to a sub plate mounted valve.

As shown in FIG. 8, the pipe spool 68 comprises a pipe 83 with two threaded ends 88. A height adjustment nut 84 is screwed on each of the ends until the desired space apart of the pipe 83 from the connections is achieved. A captive flange 86 is fixed in place over the height adjustment nut 84 with bolts 90. This minimizes binding of the connections of the pipe spool to the SPM valves and the pod base due to the tolerance between the members.

The hydraulic supply manifolds are mounted essentially on the rails, or the frame members of the pod 10. Special adjuster nuts 84 allow for the positioning of the SPM valves on the manifolds which are fixed in place by adjustment of the adjuster nuts 84, so that everything is properly leveled. Thus, when everything is tightened, none of the components are put in a bind.

The SPM valves are typical sizes, 1½", 1", and ½", and each have the same mounting philosophy as the manifolds. The valves are mounted through 4-bolt flanges (not shown) which are arranged in a rectangular pattern. The hydraulic output of each SPM valve 66 is directed through one of the pipe spools 68. As mentioned above, the lengths of the pipe spools are adjustable through their threaded ends. The spool length doesn't actually change, but the adjustment of where it "shoulders" and is tightened up makes its effective length adjustable.

Referring back to FIG. 2, the lower hydraulic module 32 is shown in one embodiment as 55" in height, and the upper electronics module 30 is shown as 60¾" tall. The electronics packages 48 are housed in the tall can in the center of the upper module 30, while the shorter can contains transformers 50.

Solenoid-operated shear-seal valves 41 are mounted in the solenoid housings 42 at the outer portions of the electronics module 30. The solenoids (not shown) mount on the inside of these enclosures. The shear-seal valves 41 mount opposite the solenoids on the outer portion of the solenoid housing 42. These valves are electro-hydraulic pilot valves. Thus, when an operator presses a button on a panel at the surface, it instructs the surface electronics to send a signal down to the electronics package to fire a particular solenoid. Then, there is some electronic verification communicated back and forth, and the solenoid is fired. When this happens, hydraulic pressure is directed from the shear-seal valve 41 associated with that solenoid down through the junction plate 38, or seal sub interface, to the appropriate SPM valve 66 in the lower hydraulic module 32. Thus, pressure is directed from the shear-seal valve 41 through the junction plate 38 down to the hydraulic pilot, the SPM valve 66.

The junction plate 38 represents a break point between the upper and lower modules. Tubing extends from the shear-seal valves 41 down to the seal subs 36, and complementary tubing extends from the seal subs 36 through the hydraulic module 32, down to the SPM valves 66. If and when the modules are disconnected, such as to bring a replacement module in, the tubing connections will already be made up in the replacement module.

The electronics are designed to have a "table" format in which each solenoid and transducer has a specific address, so the electronics can communicate with the device at that address or read back pressure from the transducer from its address. Typically, there are some functions that are programmed to be performed in sequences. For example, emergency disconnect sequences are set up for leaving the stack as quickly as possible. There are certain hydraulic functions that have to be performed to do that, which can be preprogrammed. Thus, when the operator executes the automatic disconnect sequence by pressing the appropriate button on a panel, the software and electronics performs the functions in accordance with the program. However, the sequence can be changed by the operator at any time. In other words, the operator can add functions that weren't in the program before, or he can take things out, to change the pre-set sequence.

Figure 10:
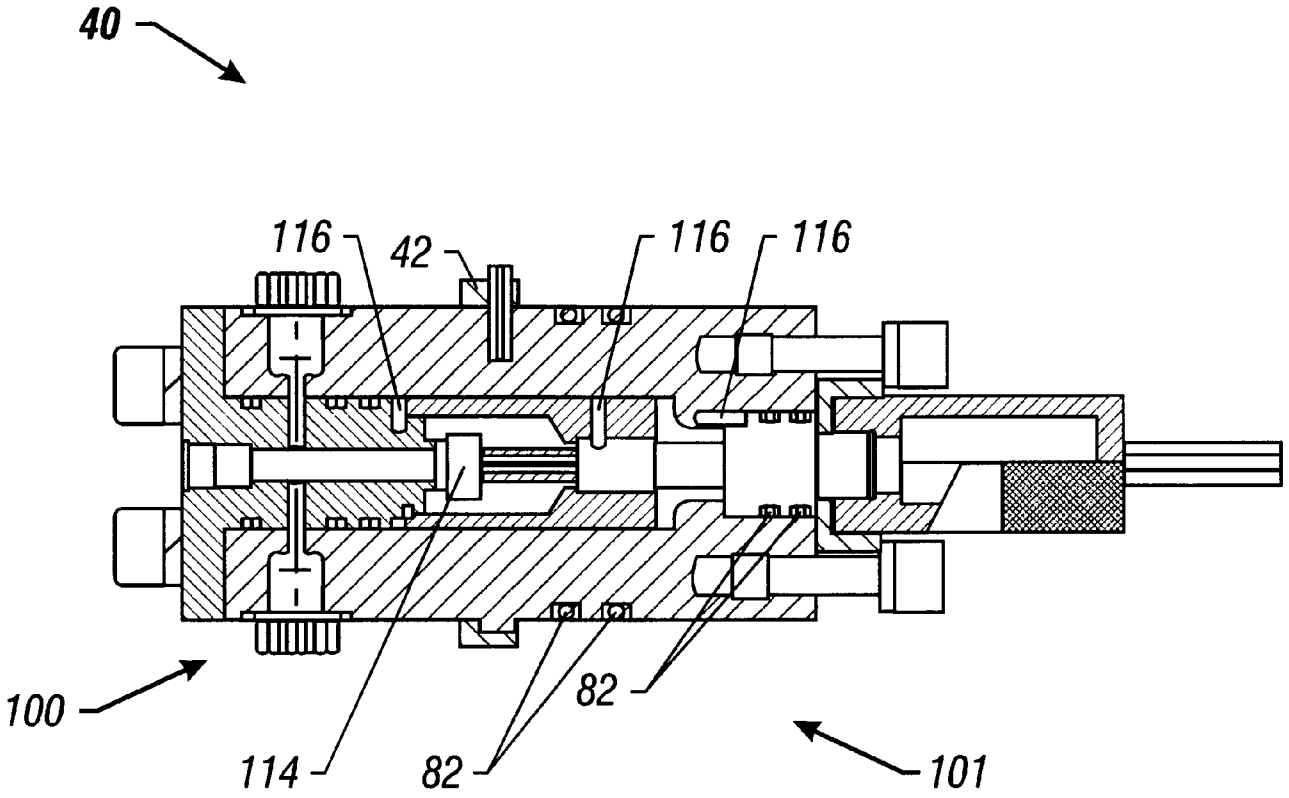
FIG. 10 shows a cross-sectional view of a transducer.

FIG. 2 also shows the transmitters, or transducers 40, that are repairable in place. The transducers 40 are shown on the bottom row of the electronics module 30, in the side elevational view. There are ten on each side of the pod. The transducers 40 convert hydraulic pressure to an analog signal, and are shown in greater detail in FIG. 10. Dual O-rings 82 provide a seal down on the outer diameter of the transducer 40 where it fits into the solenoid housing 42. All electrical connections are on the inside of the solenoid housing 42, which is filled with a non-conductive fluid. A bladder member (not shown) is mounted atop the housing 42 inside the solenoid housing cover 44 and allows the entry of sea water into the bladder to pressure-compensate the housing fluid with the sea head. In this manner, all electrical devices are contained in a "friendly" fluid.

There are dual O-ring seals that interface at multiple areas in the solenoid housing 42. Each solenoid has dual O-rings 82. The transducers 40 also have dual O-rings 82, as do the enclosure plates 60, the solenoid housing cover 44, and the seal subs 36 that interface between the housing and electronics modules. Additionally, the devices that are in the solenoid housing 42 are designed to work even if the housing has sea water in it. So the system has multiple backups, through dual seals, a friendly fluid, and electrical components that will continue to work if exposed to water.

Referring again to FIG. 10, the right hand portion of the transducer is mounted inside the solenoid housing with the friendly fluid. The left hand portion is outboard, and has pressure connection points for tying into the component whose pressure is to be measured. Orientation pins 116 are used to ensure proper alignment of the transducer. An Ashcraft sensor 114 or the like is welded to the transducer body. The wires from that sensor terminate in a connector that plugs in. The connector, or penetrator, has four pins on each end (not shown). Thus, the transducer has a make-and-break stab connection on either side of the penetrator.

The interior chamber 100 of the outer portion of the transducer 40 is sealed at one atmosphere. The exterior portion 101 of the transducer 40 inside the solenoid housing 42 is at sea head pressure. Again, there are dual O-rings 82 here that are exposed to sea head differential. The inner portion of the transducer 40 is exposed to hydraulic pressure plus the hydraulic head, so there is quite a bit of differential across this joint. There is an orientation pin on the transducer cap that only allows the sensor portion to be installed in one way. The internal connector is keyed so that it only fits one way. The penetrator has a pin so that it's also oriented one way. As a result, all the components can be made up with confidence that the alignment is correct. The construction of the transducer 40 allows it to be pulled out of the solenoid housing 42 and replaced without draining the fluid from the housing. Replacement of the body portion or the penetrator would require draining the housing.

The solenoids do not have this feature. The solenoids have a boot-type seals over two single pin connectors that essentially pressure energize the seal, but some of the fluid will necessarily be lost from the housing during the change out of a solenoid. However, the shear-seal portion opposite the solenoid can be loosened without disturbing the fluid, and the shear-seal is the most likely the part that will need service. For example, maybe an O-ring might have failed or something similar. If the solenoid must be removed, the fluid will be drained only to the level of the solenoid.

The prior art transducers are mounted on the inside of the housing just like the solenoid, and the pressure connections come from the outside. So if anything happens to a prior art transducer, the solenoid housing must be drained to pull the transducer from the inside. This of course entails a lot of work. By contrast, if something happens to the sensing element of the present invention, the removal of four screws enables the inner transducer housing to be pulled out and replaced without having to disturb the fluid contents of the solenoid housing.

The solenoid shear-seal valves 41 are seal sub mounted, so taking those off is also just a matter of removing a couple of screws. Thus, there is no need to disturb the tubing within the upper module as in the prior art devices.

The seal subs 36 also have dual O-rings 82, but if one O-ring 82 fails, it can be repaired in place by unscrewing the male member from the lower junction plate 38 without removing the entire electronics module 30. The seal sub interface plates functionally connecting the modules have a "lost motion" float (not shown) built into the connections between the junction plate 38 and their parts, so that when the pod 10 is lifted, these connections are not loaded in tension with the weight of the pod. There are four lift points 46 for raising the pod 10, shown generally about the solenoid housings 42 in FIG. 2. The plate junction plate 38 attached to the upper electronics module 30 has slack with respect to the junction plate 38 that is attached to the lower hydraulic module 32. In this manner, when the pod is lifted, the lost motion float that is built into the junction plates 38 is going to be largely taken up. If there was no such lost motion built in, the bolts connecting the plates would be carrying the weight of the pod. Special shoulder bolts are used to provide the "loose" connections resulting in the lost motion. Again, the clear advantage in this design is that it doesn't load that junction plate 38 with the full weight of the lower module 32. The only loading on the interface bolts will result from the separating force of pressure acting at the seal subs. A similar lost motion float could also be used between the stab 34 and the pod base block 72 to relieve the load of the hydraulic cylinder 64. This leaves the stab 34 free to float against the pad base block 72.

Figure 11A:
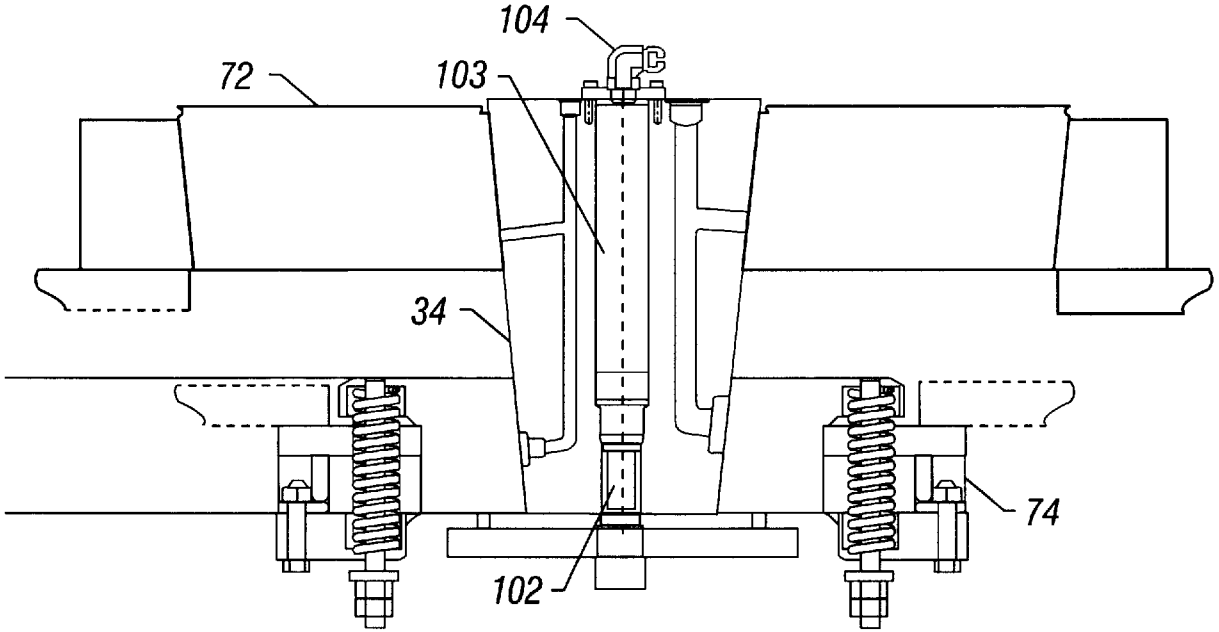
FIG. 11*a* shows a frontal view of a stab with an engaged electrical connector.
Figure 11B:
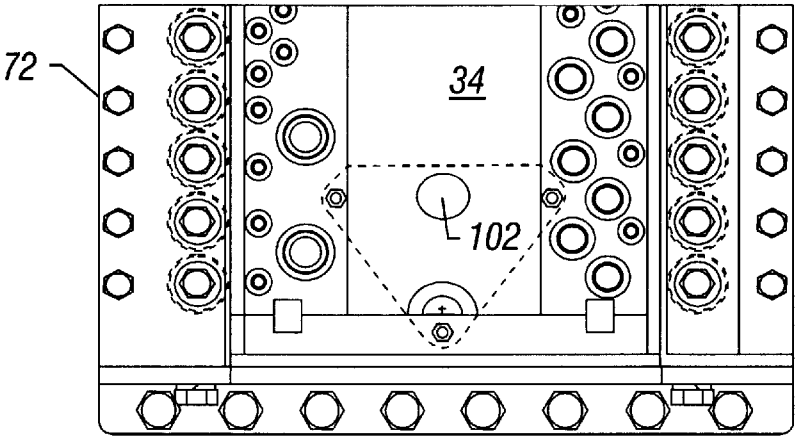
FIG. 11*b* shows an partial overhead view of a BOP receiver block with an electrical connector.

FIGS. 11*a* and 11*b* illustrate an electrical connection that is provided through the stab 34. An electrical connector 102 that can make-or-break under water has been specially adapted for the hydraulic pod stab 34. The connector 102 permits electrical communication directly between the electronics module 30 and the BOP stack. Thus, the connection is automatically made up by the lowering of the stab 34 into the BOP receiver block 74. The male portion of the connector is fastened to a plate that's mounted on the bottom side of the BOP receiver block 74. The female portion is mounted in the lower portion of the pod stab 34. So when the stab 34 comes into the BOP receiver block 74, it automatically makes up the electrical connection. The female is designed so that when it disconnects, the sockets in the female connection are sealed off and may be pulled up so that they work subsea. The male pins are on the non-power side when disconnected.

In a preferred embodiment, there is room for two connectors on the lower surface of the stab 34. One connector, for example, is related to a "smart" BOP read-back. At the upper portion of the stab 34, there's a 90° elbow 104 fitting that has a connection on it for attachment to a female swivel hose connection. A length of hose (not shown) is designed to lay on top of the stab 34, The hose has a loop so that when the stab moves up and down, the hose is able to flex freely and is not unduly tensioned. The electrical connector on the hose end opposite the stab feeds through a bulk-head into a junction box 56 (shown in FIG. 3) above the stab 34, where it is electrically connected to the electronics module components. The junction box 56 is adapted for six electrical connectors, four on top, and two underneath. The connector seal points each have a pressure port for testing between the o-ring seals to ensure sealing integrity. A jumper assembly, which connects to junction box 56, comprises wires with soldered connections on each end with boot seals over each connection. After the connections for the jumper assembly are terminated, the hose is filled with fluid. Thus, the electrical wires inside the hose are immersed in a friendly fluid that pressure-compensates the hose with the sea. The flexible hose in effect becomes a pressure membrane to balance pressure.

Figure 12A:
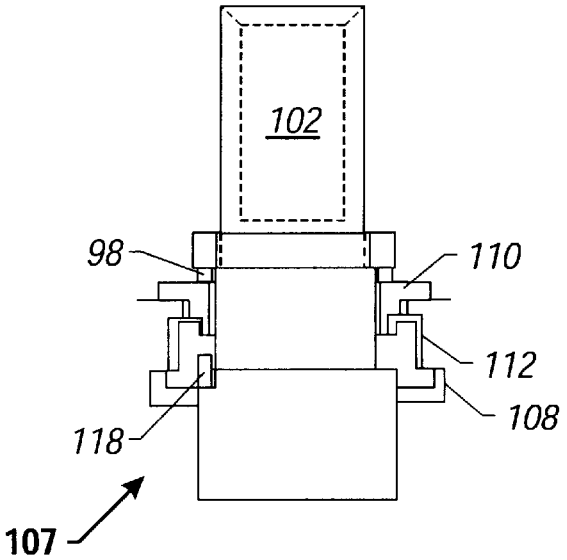
FIG. 12*a* shows an electrical connector with a connector guide.
Figure 12B:
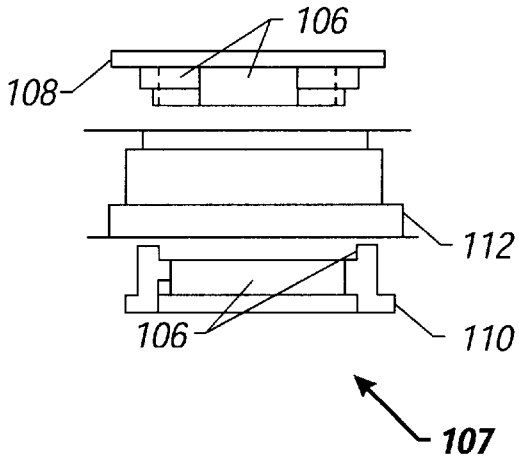
FIG. 12*b* shows an exploded view of a connector guide.
Figure 12C:
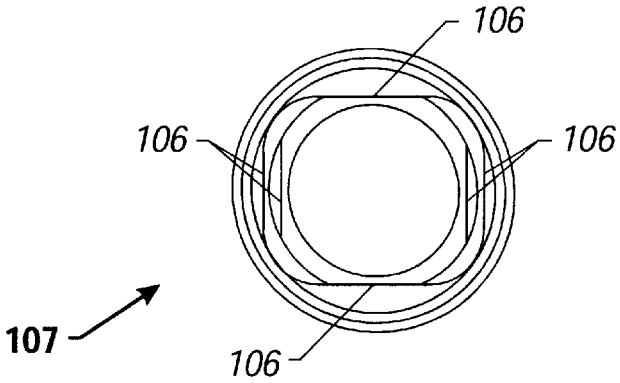
FIG. 12*c* shows an overhead view of a connector guide.

FIG. 11*a* shows the plate that receives the mating female connector in its position, bolted to the underside of the BOP receiver block 74. Because misalignments between the male and female connectors can occur, the connectors are brought together by complementary flats 106 in the connector guide 107. As seen in FIGS. 12*a*, 12*b* and 12*c*, there are flats 106 in the upper connector member 108, and complementary flats 106 on the lower connector member 110. A pin 118 is included in the connector guide 107 to prevent rotation with the connector 102 and the connector guide 107. The flats 106 function by allowing movement in all directions to parallel to the stab 34 and the BOP receiver block 74 which allows the connectors line themselves up. Also, included is a wave spring 98 which is located between the upper connector member 108 and the electrical connector 102. The wave spring 98 allows some elastic movement while the electrical connector 102 is being seated.

Since the connection is made up by four pins, it won't permit relative rotation between the male and female connectors. However, the connection will handle relative movement in either of the X-Y directions. In other words, the flats 106 on one connector won't let the mating connector rotate, but will let it slide. Relative movement is permitted in two degrees of freedom, and results in automatic alignment between the parts to complete the desired electrical connection.

Although exemplary embodiments have been shown and described, those skilled in the art will recognize that other embodiments fall within the spirit and scope of the invention. Accordingly, the invention is not limited to the disclosed embodiments, but rather is defined solely by the scope of the appended claims.

What is claimed:

1. An apparatus for controlling a blowout preventer, comprising:

an electronics package which receives a control signal;

a plurality of solenoids, mounted in a solenoid housing, which receive fire signals from the electronics package;

a plurality of shear seal valves which translate the fire signals into hydraulic pressure; and an internal stab which receives the hydraulic pressure and transfers it through a plurality of fixed conduits to the blowout preventer.

2. The apparatus of claim 1, wherein the fixed conduits are internal to the stab.

3. The apparatus of claim 1, further comprising:

a plurality of pressure activated packer seals which connect the fixed conduits to the blowout preventer.

4. The apparatus of claim 3, wherein a pressure activated packer seal comprises:

a circular rigid support with an interior ledge, an exterior slot and a bottom channel;

a flexible seat attached around the interior ledge;

a tapered flange attached around the exterior slot; and a wave spring attached around the bottom channel.

5. The apparatus of claim 4, wherein the flexible seat is made of rubber.

6. The apparatus of claim 4, wherein the rigid support is made of metal.

7. The apparatus of claim 4, wherein the tapered flange is made of rubber.

8. The apparatus of claim 4, wherein the wave spring is made of metal.

9. The apparatus of claim 1, further comprising:

a plurality of adjustable length pipe spools which transfer the hydraulic pressure from the shear seal valves.

10. The apparatus of claim 9, wherein a pipe spool comprises:

a pipe with two threaded ends;

at least one length adjustment nut which is attached to each threaded end of the pipe;

a captive flange which fits over each length adjustment nut; and a plurality of bolts which fix the captive flange in place over the length adjustment nut.

11. The apparatus of claim 1, further comprising:

a non-conductive fluid within the solenoid housing; and a plurality of transducers, mounted within the solenoid housing, which translate the hydraulic pressure to a signal.

12. The apparatus of claim 11, wherein the plurality of transducers are located in an accessible position within the solenoid housing.

13. The apparatus of claim 11, wherein a transducer can be removed from the solenoid housing without disturbing the non-conductive fluid in the solenoid housing.

14. The apparatus of claim 1 further comprising:

a pressure equalization bladder mounted with the solenoid housing.

15. The apparatus of claim 14, wherein the pressure equalization bladder is filled with sea water.

16. The apparatus of claim 1, further comprising:

an electrical cable which extends through the stab;

an electrical connector which connects the electrical cable to the blowout preventer; and a connector guide which correctly aligns the electrical connector without rotation.

17. The apparatus of claim 16, wherein the connector guide correctly aligns the electrical connector by limiting the movement of the electrical connector to two perpendicular axes which are parallel to the blowout preventer.

18. The apparatus of claim 17, wherein the connector guide comprises:

a guide frame;

an upper connector member with formed flats, which is movably mounted within the guide frame; and a lower connector member with formed flats, which is movably mounted within the guide frame.

19. The apparatus of claim 1, further comprising:

a plurality of seal subs which are accessible without removal of other elements of the apparatus.

20. The apparatus of claim 1, further comprising:

at least one junction plate with a lost motion float.

21. The apparatus of claim 1, further comprising:

a plurality of enclosure plates.

22. An apparatus for controlling a blowout preventer comprising:

an electronics package which receives a control signal;

a solenoid housing;

a plurality of solenoids, mounted within the solenoid housing, which receive fire signals from the electronics package;

a plurality of enclosure plates;

a plurality of shear seal valves, mounted on the solenoid housing, which translate the fire signals into hydraulic pressure;

a pressure equalization bladder, mounted within the solenoid housing, which is filled with sea water;

a non-conductive fluid within the solenoid housing;

a plurality of transducers, mounted in an accessible position within the solenoid housing wherein a transducer can be removed from the solenoid housing without disturbing the non-conductive fluid, which translate the hydraulic pressure into a signal;

a plurality of seal subs which are accessible without removal of other elements of the apparatus;

at least one junction plate with a lost motion float;

a plurality of adjustable length pipe spools which receives the hydraulic pressure from the seal subs, wherein a pipe spool comprises a pipe with two threaded ends, at least one length adjustment nut which is attached to each threaded end of the pipe, a captive flange which fits over each length adjustment nut, and a plurality of bolts which fix the captive flange in place over the length adjustment nut;

an internal stab which receives the hydraulic pressure from the pipe spools and transfers it through a plurality of fixed internal conduits to the blowout preventer;

a plurality of pressure activated packer seals which connect the fixed internal conduits of the stab to the blowout preventer, wherein a pressure activated packer seal comprises a circular metal support with an interior ledge, an exterior slot and a bottom channel, a rubber seat attached around the interior ledge, a rubber tapered flange attached around the exterior slot, and a metal wave spring attached around the bottom channel;

an electrical cable which extends through the stab;

an electrical connector which connects the electrical cable to the blowout preventer; and a connector guide which correctly aligns the electrical connector without rotation by limiting the movement of the electrical connector to two perpendicular axes which are parallel to the blowout preventer, wherein the connector guide comprises a guide frame, an upper connector member with formed flats, which is movably mounted within the guide frame, a lower connector member with formed flats, which is movably mounted within the guide frame.

23. A method for controlling a blowout preventer comprising:

receiving an electronic control signal;

translating the electronic control signal into hydraulic pressure;

transferring the hydraulic pressure to the blowout preventer through a stab with fixed internal conduits; and translating the hydraulic pressure into a signal through a plurality of transducers mounted on an accessible position within a solenoid housing, wherein a transducer can be removed from the solenoid housing without disturbing a non-conductive fluid in the solenoid housing.

24. The method of claim 23, further comprising:

equalizing the pressure within a solenoid housing with a pressure equalization bladder.

25. The method of claim 23, further comprising:

transferring the hydraulic pressure to a stab through adjustable length pipe spools.

26. The method of claim 23, further comprising:

connecting an electrical cable, which extends through the stab, to the blowout preventer with an electrical connector which is correctly aligned without rotation by a connector guide.

27. The method of claim 23, wherein the fixed internal conduits of the stab are connected to the blowout preventer with pressure energized packer seals.

28. A method for controlling a blowout preventer, comprising:

receiving an electronic control signal in an electronic control package sending a fire signal from the electronic control package to a plurality of solenoids located within a solenoid housing;

firing the solenoids;

translating the firing of the solenoids into hydraulic pressure through a plurality of shear seal valves located on the solenoid housing;

equalizing the pressure within a solenoid housing with a pressure equalization bladder filled with sea water;

translating the hydraulic pressure into a signal through a plurality of transducers, mounted in an accessible position within the solenoid housing wherein a transducer can be removed from the solenoid housing without disturbing a non-conductive fluid in the solenoid housing;

transferring the hydraulic pressure from the shear seal valves to a plurality of seal subs;

transferring the hydraulic pressure from the seal subs through adjustable pipe spools to an internal stab with fixed internal conduits, wherein a pipe spool comprising a pipe with two threaded ends, at least one length adjustment nut which is attached to each threaded end of the pipe, a captive flange which fits over each length adjustment nut, and a plurality of bolts which fix the captive flange in place over the length adjustment nut;

transferring the hydraulic pressure to the blowout preventer through the internal stab with fixed internal conduits wherein the fixed internal conduits of the stab are connected to the blowout preventer with pressure energized packer seals, wherein a pressure activated packer seal comprises a circular metal support with an interior ledge, an exterior slot and a bottom channel, a rubber seat attached around the interior ledge, a rubber tapered flange attached around the exterior slot, and a metal wave spring attached around the bottom channel;

connecting an electrical cable, which extends through the stab, to the blowout preventer with an electrical connector which is correctly aligned without rotation by a connector guide by limiting the movement of the electrical connector to two perpendicular axes which are parallel to the blowout preventer, wherein the connector guide comprises a guide frame, an upper connector member with formed flats, which is movably mounted within the guide frame, a lower connector member with formed flats, which is movably mounted within the guide frame.

* * * * *